US006454323B1

(12) United States Patent
Mills

(10) Patent No.: US 6,454,323 B1
(45) Date of Patent: Sep. 24, 2002

(54) HIGH-SECURITY AUXILIARY DOOR LOCK

(76) Inventor: Lonnie Mills, 35425 Glenwood Rd., Wayne, MI (US) 48184

( * ) Notice: Subject to any disclaimer, the term of this patent is extended or adjusted under 35 U.S.C. 154(b) by 0 days.

(21) Appl. No.: 09/501,458

(22) Filed: Feb. 10, 2000

(51) Int. Cl.[7] ..... E05C 17/54
(52) U.S. Cl. ..... 292/339; 292/338; 16/82
(58) Field of Search ..... 292/339, 338, 292/343, 259 R; 16/82

(56) References Cited

U.S. PATENT DOCUMENTS

| | | | | | |
|---|---|---|---|---|---|
| 790,653 | A | | 5/1905 | Notthoff | |
| 1,185,547 | A | * | 5/1916 | Rugar | |
| 1,304,394 | A | * | 5/1919 | Shyer | |
| 1,615,357 | A | * | 1/1927 | Bruhn et al. | |
| 3,583,743 | A | | 6/1971 | Newell | 292/339 |
| 4,070,049 | A | | 1/1978 | Brewer | 292/263 |
| 4,300,796 | A | | 11/1981 | Lane | 292/339 |
| 4,438,640 | A | | 3/1984 | Willis | 70/94 |
| 4,666,195 | A | * | 5/1987 | Thomas | 292/338 |
| 4,822,086 | A | | 4/1989 | Brown | 292/338 |
| 5,064,232 | A | | 11/1991 | Quarberg | 292/339 |
| 5,294,159 | A | * | 3/1994 | Corrigan | 292/339 |
| 5,392,026 | A | | 2/1995 | Marik | 340/546 |
| 5,544,386 | A | * | 8/1996 | Cobb | 16/82 |
| 5,873,273 | A | * | 2/1999 | Vick | 292/259 R |
| 5,951,072 | A | * | 9/1999 | MecKlary | 292/339 |
| 5,988,710 | A | | 11/1999 | Kortschot et al. | 292/339 |

* cited by examiner

*Primary Examiner*—Anthony Knight
*Assistant Examiner*—Mark Williams
(74) *Attorney, Agent, or Firm*—Gifford, Krass, Groh, Sprinkle, Anderson & Citkowski, PC

(57) ABSTRACT

A high-security auxiliary door locking device includes a brace having an upper section which pivotally attaches to the inside of a door, and a lower section which engages with the floor at a distance spaced apart from the door. The lower section includes a pair of floor engaging ends, and the upper section preferably pivotally attaches to the inside of the door at a point above the level of the door knob. Although a single pivotal attachment may be used, in the preferred embodiment, a transverse bar is used across the back of the door, which hinges at two points near the side edges of the door. With such an arrangement, application of an entry force to the outside surface of the door, causes the door to move upwardly against the jam for additional resistance. To obtain entry from outside, a small lockable high-security door may be provided so as to enable an individual with a key to unlock the door, reach in, and pull up on the brace to gain entry. Preferably a chain is provided for such purpose. To enhance aesthetic appeal, the brace may be embedded within the door when folded up or down, with outer coverings and surfaces being used to obscure the structure when not in use.

23 Claims, 3 Drawing Sheets

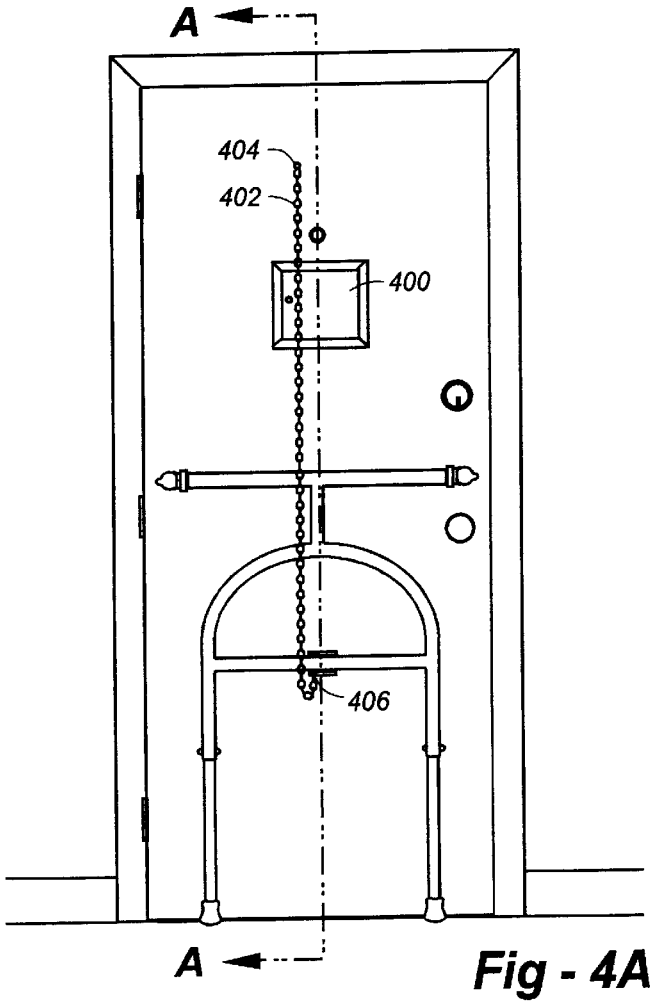
Fig - 4A
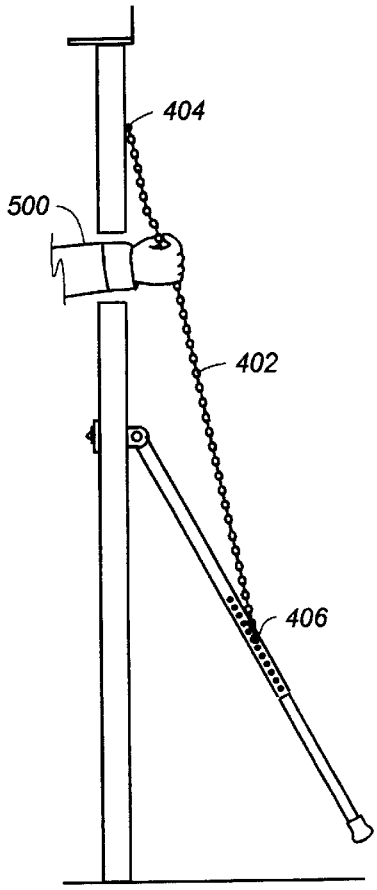
Fig - 4B (A-A)

HIGH-SECURITY AUXILIARY DOOR LOCK

FIELD OF THE INVENTION

This invention relates generally to door locks, and, in particular, to door-mounted high-security locking mechanism.

BACKGROUND OF THE INVENTION

The desire for high security, auxiliary door locks has been recognized for decades, and many patents have issued which concern this subject matter. Door-mounted devices may be broadly classified in terms of where they attach to the inside of the door. That is, there are some devices which provide support under the door knob, others which mount near the floor, and still others which mount elsewhere on the door below the level of the door knob.

In terms of door knob-coupled arrangements, a search of the prior identified the following U.S. Pat. Nos.:

U.S. Pat. No. 790,653—an elongated door securer is locked into place through user engagement of an articulating joint;

U.S. Pat. No. 3,583,743—includes a ratchet mechanism enabling the user to more quickly spread the length of the bar between the door knob and the floor;

U.S. Pat. No. 4,070,049—features a telescoping brace which fits between an inside face of the door and an adjacent support surface such as a wall;

U.S. Pat. No. 4,300,796—uses a pin on a chain which engages with indents on a telescoping security bar to adjust the length thereof;

U.S. Pat. No. 4,438,640—includes an adjustable prop member which fits between a door knob and the floor, but which optionally includes lock and/or warning means to further help guard against unauthorized entry;

U.S. Pat. No. 4,822,086—an adjustable-length member telescopes between a floor and mounts to a point on the door immediately below a door knob;

U.S. Pat. No. 5,064,232—an adjustable security bar with one end with a pivot mount against the floor, and another end with a cup-shaped recess that fits over round knobs;

U.S. Pat. No. 5,392,026—an elongate member which fits between a door knob and a floor, includes an alarm device which triggers in response to physical tampering above a given threshold level;

U.S. Pat. No. 5,544,386—a door stopper device having an upper U-shaped end which couples to a door knob, and a plurality of feet which rest against the floor and the bottom edge of the door itself; and U.S. Pat. No. 5,988,710—a variable length security bar which permits telescoping adjustment of proximal and distal sections.

In terms of mechanisms which attach lower to the floor, the following U.S. patents were identified:

U.S. Pat. No. 1,332,473—an auxiliary door lock which fastens to the bottom edge of the door toward the side edge of the door which opens, having a plate 6 which is urged downwardly against the floor through a turnbuckle arrangement.

U.S. Pat. No. 2,709,615—a spring-loaded door stop engages with the bottom edge of a door, to stop the door from swinging in either direction U.S. Pat. No. 4,641,869—a door brace includes an elongate canted arm having an upper end which interlocks with the door, and a lower, floor-engaging end spaced away from the door. The upper end is shaped and dimensioned such that when forced entry is attempted, the door is compressed into interlocking engagement with the upper end of the arm, enabling the brace to resist shear forces which tend to separate the upper end of the brace from the door during an attempted forced entry.

U.S. Pat. No. 5,135,273—a door prop mounted just above the bottom edge of the door claims to be easy to install, while allowing the door to be opened a small amount while remaining insufficient for entry. A ratchet with saw teeth is used for adjustment purposes.;

U.S. Pat. No. 5,217,268—a variation of the mechanism disclosed in U.S. Pat. No. 5,135,273, naming the same individual as inventor;

U.S. Pat. No. 5,218,341—a door locking device with an adjustable shaft having an arcuate shape, which extends between the floor and a point on the inside of the door. An alarm device is mounted on the shaft portion which is responsive to shocks affecting the door handle above a predetermined threshold value.

SUMMARY OF THE INVENTION

The subject invention improves upon the art of high-security auxiliary door locking devices by providing a brace having an upper section which pivotally attaches to the inside of a door, and a lower section which engages with the floor at a distance spaced apart from the door. In contrast to existing devices, the lower section includes a pair of floor engaging ends, and the upper section preferably pivotally attaches at one or more points above the level of the door knob. Although a single pivotal attachment may be used, in the preferred embodiment, a transverse bar is used across the back of the door, which hinges at two points near the side edges of the door. With such an arrangement, application of an entry force to the outside surface of the door, causes the door to move upwardly against the jam for additional resistance.

In a basic configuration, the security brace according to the invention may be used by an individual within a home or a room and flipped up or otherwise adjusted so as not to interfere with door opening for ingress and egress. In an alternative embodiment, however, to obtain entry from outside, a small lockable high-security door is provided, enabling an individual with a key to unlock the door, reach in, and pull up on the brace to gain entry. Preferably a chain is provided for such purpose. To enhance aesthetic appeal, a brace according to the invention may be embedded within the door itself, with outer coverings and surfaces being used to obscure the structure when not in use.

BRIEF DESCRIPTION OF THE DRAWINGS

FIG. 4A is a drawing of a different alternative embodiment of the invention, including a high security door enabling a key holder to pull on the brace and gain entry from outside; and FIG. 4B is a cross-section of the embodiment of FIG. 4A, illustrating how a user would pull up on the brace to disengage it from the floor.

DETAILED DESCRIPTION OF THE INVENTION

Figure 1:
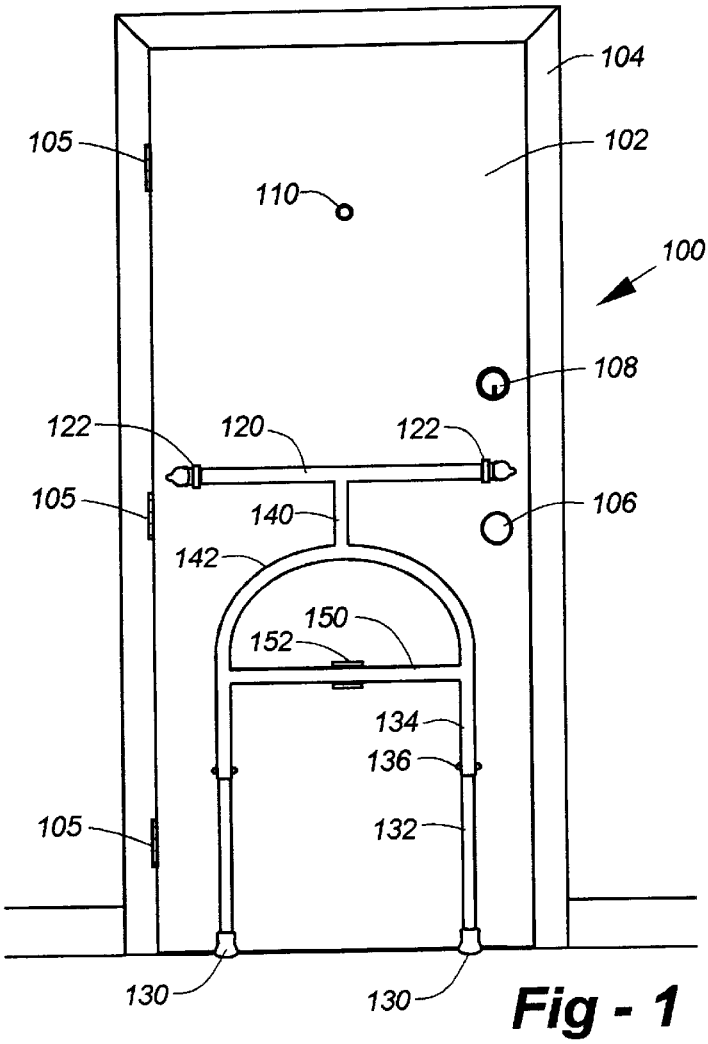
FIG. 1 is a view looking to inside surface of a door equipped with a preferred embodiment of the invention.

Making reference to the drawings, FIG. 1 illustrates, from a front-on perspective, a preferred embodiment of the invention, depicted generally at 100. The invention includes a rigid structural brace, having an upper section which pivotally attaches to the inside surface of a door to be secured, and a lower section which terminates in at least two floor-engaging feet 130. The brace may be constructed from any suitable material having sufficient strength and rigidity, including different metals, reinforced fibers, hard plastics, and so forth, though in a preferred embodiment, steel components are used.

The door 102 is typically contained within a door frame 104, being hinged thereto with hinges 105, typically two or three in number. The door knob is shown at 106, as well as a locking device such as deadbolt 108, the existence of which is inconsequential. In addition, although the door 102 is shown opening inwardly being hinged at the left, it will be apparent to those of skill that the invention is applicable to doors which open in either way.

In the embodiment of FIG. 1, the upper section of the brace 100 is pivotally attached to the door at two points 122 utilizing a transverse bar 120. The pivotal attachment to the door transitions to a plurality of floor-engaging feet 130 through other structural members, such as a central member 140 which interconnects to a curved element 142. Other types of frameworks may also be used, so long as the resulting structure is sufficiently strong to meet the purpose of the invention.

To hold the brace out of the way during periods of non-use, a member 152 is provided which, with the lower ends retracted as described below, fits into a clip 152 which holds the assembly against the door face. As a further alternative, the brace may be flipped up entirely, such that the lower section rests near the top of the door, with appropriate means being provided to hold it in such position without falling. The lower ends 130 preferably include some means to frictionally engage with the floor, such means being as simple as rubber-tips or pivoting pads as discussed in the prior art. The lower ends are associated with telescoping members 132 which fit into corresponding sections 134, enabling the length of each lower end to be adjusted, for example, through the preferred use of pins 136 which are received by corresponding apertures formed in at least the members 134.

Figure 2:
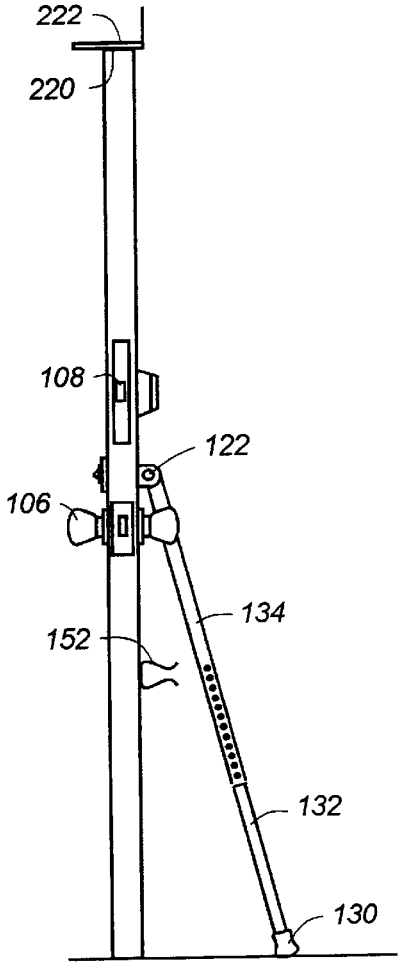
FIG. 2 is a side-view drawing of the embodiment of FIG. 1.

This arrangement is perhaps best seen in FIG. 2, which presents a side view of the preferred embodiment of FIG. 1. From this perspective, the distance of the feet 130 of the brace can be more easily seen relative to the inner surface of the door 102. With such an arrangement, it can also been seen how, with the application forced to the outside surface of the door, a pivoting action would occur at the points 130 and 122, causing the door to lift upwardly. Assuming the top edge 220 of the door is sufficiently close to the lower surface 222 of the door jamb, this outward application of force would cause the door to move upward and become lodged and resist further intrusion.

Figure 3:
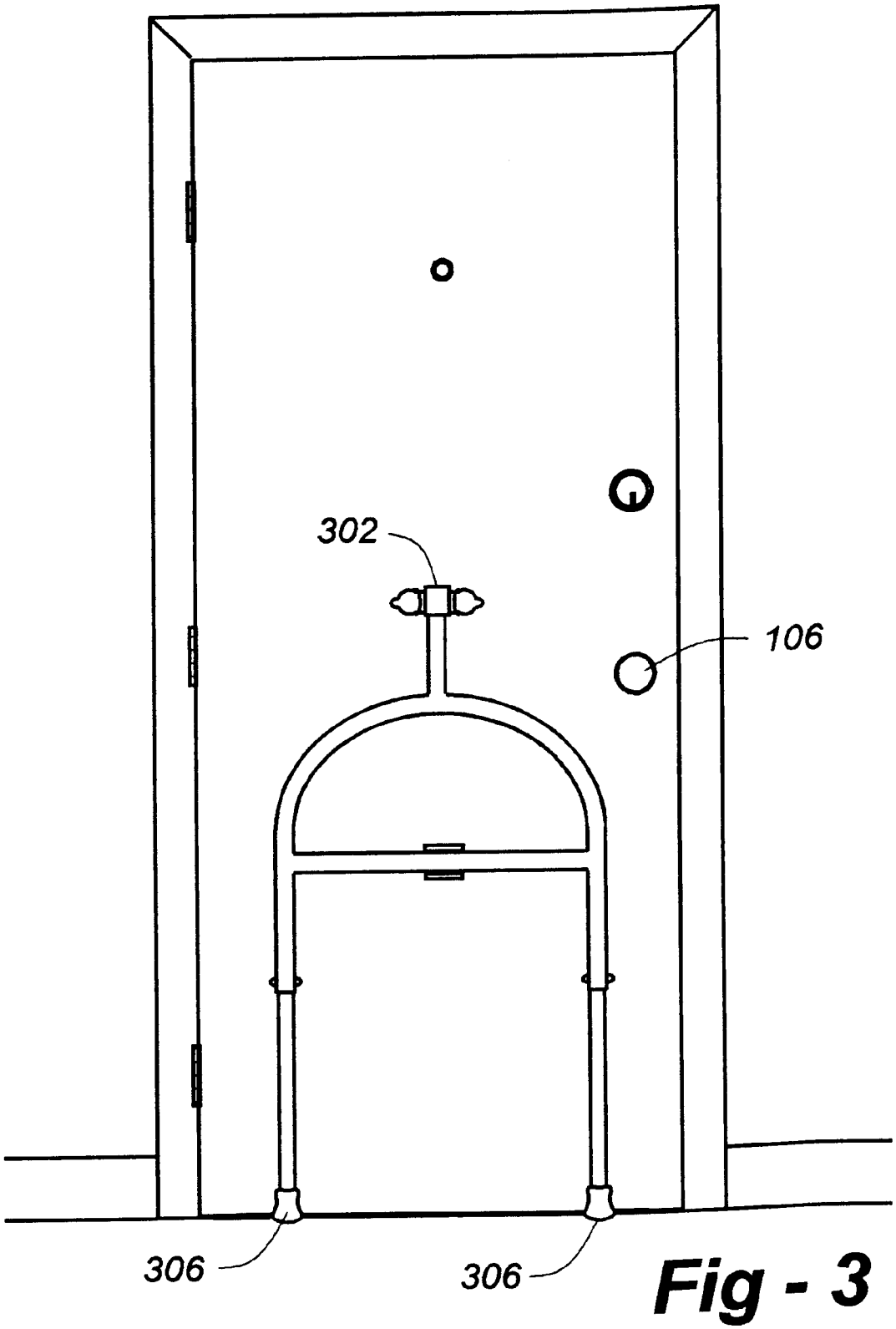
FIG. 3 is a drawing of an alternative embodiment of the invention wherein the upper section of the brace is hinged at a single point on the door, but which terminates in a plurality of lower floor-engaging feet.

FIG. 2 also shows how the pivoting connection to the door at 222 is preferably secured, that is, through a bolt that penetrates through the door and secured on the inside with a nut or other fastener. On the outside a smooth, preferably domed or otherwise rounded feature is exposed, making it impossible to grip and remove from outside of the premises. FIG. 2 makes it further evident that, in the preferred embodiment, the pivoting attachment to the door takes place above the level of the door knob 106. As discussed above, although a pair of pivoting connections 122 are employed in the preferred embodiment, a single pivoting connection may be used, as shown in FIG. 3. In all embodiments, however, a plurality of floor-engaging feet would nevertheless be used.

The embodiments just described would allow the occupant of a home or room in a home to secure a door from the inside to avoid intrusion, but without the capability of being able to disengage the brace from the outside. The ability to disengage the brace may be an important consideration, however, in the case that it is desirable to use the security system of the invention at all times, for example, on the front door of a dwelling. It also may be necessary to obtain entry to the premises by a relative or friend, in the case that an elderly person using the device becomes incapacitated. To meet these objectives, an alternative embodiment of the invention provides a small security door and a pull chain or other device, allowing an outsider authorized to open the security door to pull up on the brace and gain entry.

This embodiment is shown in the drawing of FIGS. 4A, and 4B, which is a cross-sectional view of the drawing of FIG. 4A. In this embodiment, a chain 402 or other graspable member is used to pull up on the brace from outside, having gained access through a small lockable door 400. Preferably, the door 400 is a security door of the kind found on small safes, including a hardened encasement and pick-proof lock. If a chain is used, is preferably secured at a point 404 positioned above the door 400. and connects to the brace at a point 406, preferably on the lower transverse bar 150 shown in FIG. 1. Accordingly, as perhaps best seen in FIG. 4B, by opening the small security door, a user 500 is able to grasp the chain 402, and pull up on the brace, thereby, with the other hand, for example, unlock the main door, and push it in to gain entry.

I claim:

1. A device for securing a hinged door of the type which swings open into a room, the door having an inner surface which faces into the room, an outer surface which faces a person wishing to enter the room, and a knob or handle mounted on the inner surface of the door at a height above a floor, the device comprising:

a rigid brace having an upper portion and a lower portion, the upper portion of the brace being pivotally attached to the inner surface of the door at two spaced apart points at a height above the knob or handle, and a lower section terminating in a plurality of feet which rest against the floor; and the length of the brace being adjustable so that, with the door closed, the door moves upwardly against the door jam through the application of force against the outer surface of the door.

2. The device of claim 1, wherein the lower section of the brace includes two feet which rest against the floor.

3. The device of claim 1, wherein the upper section of the brace is pivotally attached to a pair of points on the inner surface of the door through a transverse bar.

4. The device of claim 1, further including a relatively small high-security door through the door, enabling the person to reach through the high-security door and grasp at least a portion of the brace, and pull it up to gain entry to the room.

5. The device of claim 4, further including a chain having one end attached to the brace and a second end attached the inner surface of the door at a point above the high-security door enabling a user to pull up on the brace to disengage it from the floor.

6. The device of claim 1, wherein the length of the brace is adjustable through manual manipulation.

7. The device of claim 6, wherein the manual adjustment is accomplished through a plurality of pin-receiving apertures.

8. A device for securing a hinged door of the type which swings open into a room, the door having an inner surface which faces into the room, an outer surface which faces a person wishing to enter the room, and a knob or handle mounted on the inner surface of the door at a height above a floor, the device comprising:

a rigid brace having an upper portion and a lower portion, the upper portion of the brace being pivotally attached to the inner surface of the door, and a lower section terminating in a plurality of feet which rest against the floor; and a relatively small high-security door through the door, enabling an individual on the outside of the door to grasp at least a portion of the brace, and pull it up to gain entry.

9. The device of claim 8, wherein the upper portion of the brace is pivotally attached to the inner surface of the door at a height above the knob.

10. The device of claim 8, wherein the lower section of the brace includes two feet which rest against the floor.

11. The device of claim 8, wherein the upper section of the brace is pivotally attached to a pair of points on the inner surface of the door through a transverse bar.

12. The device of claim 8, further including a chain attached to the brace enabling the person to reach through the high-security door and pull up on the brace to disengage it from the floor.

13. The device of claim 8, wherein the length of the brace is adjustable through manual manipulation.

14. The device of claim 13, wherein the manual adjustment is accomplished through a plurality of pin-receiving apertures.

15. A device for securing a hinged door of the type which swings open into a room from a surrounding door jam, the door having side edges, an inner surface which faces into the room, an outer surface which faces a person wishing to enter the room, and a knob or handle mounted on the inner surface at a height above a floor, the device comprising:

a rigid brace having an upper portion and a lower portion, the upper portion of the brace being pivotally attached to the inner surface of the door at two spaced apart points, and a lower section terminating in two feet which rest against the floor at points spaced apart from the door proximate to the side edges thereof along a line generally parallel to the inner surface; and the length of the brace being adjustable so that, with the door closed, the door moves upwardly against the doorjam through the application of force against the outer surface of the door.

16. The device of claim 15, wherein the upper portion of the brace is pivotally attached to the inner surface of the door at a height above the knob.

17. The device of claim 15, wherein the upper section of the brace is pivotally attached to a pair of points on the inner surface of the door through a transverse bar.

18. The device of claim 15, further including a relatively small, high-security door through the door, enabling an individual on the outside of the door to reach through the high-security door and grasp at least a portion of the brace, and pull it up to gain entry.

19. The device of claim 18, further including a chain attached to the brace enabling the person to reach through the high-security door and pull up on the brace to disengage it from the floor.

20. The device of claim 15, wherein the length of the brace is adjustable through manual manipulation.

21. The device of claim 20, wherein the manual adjustment is accomplished through a plurality of pin-receiving apertures.

22. The device of claim 15, wherein the brace is pivotally attached to the door at two spaced-apart pivot points proximate to the side edges of the door.

23. The device of claim 22, wherein each pivot point is positioned directly above one of respective feet.

* * * * *